US010990038B2

(12) United States Patent
Berger et al.

(10) Patent No.: US 10,990,038 B2
(45) Date of Patent: Apr. 27, 2021

(54) APPARATUS FOR USE IN AN ELECTROGRAPHIC PRINTER

(71) Applicant: HP Indigo B.V., Amstelveen (NL)

(72) Inventors: Shachar Berger, Ness Ziona (IL); Shmuel Borenstain, Ness Ziona (IL); Regina Guslitzer, Ness Ziona (IL); Gregory Katz, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/605,293

(22) PCT Filed: Oct. 10, 2017

(86) PCT No.: PCT/EP2017/075755
§ 371 (c)(1),
(2) Date: Oct. 15, 2019

(87) PCT Pub. No.: WO2019/072376
PCT Pub. Date: Apr. 18, 2019

(65) Prior Publication Data

US 2020/0241446 A1 Jul. 30, 2020

(51) Int. Cl.

| | |
|---|---|
| ***G03G 15/10*** | (2006.01) |
| ***G03G 15/06*** | (2006.01) |
| ***G03G 15/20*** | (2006.01) |
| ***G03G 15/00*** | (2006.01) |

(52) U.S. Cl.
CPC ..... *G03G 15/104* (2013.01); *G03G 15/065* (2013.01); *G03G 15/2017* (2013.01); *G03G 15/5045* (2013.01)

(58) Field of Classification Search
CPC ..... G03G 15/104; G03G 9/131; G03G 9/132
See application file for complete search history.

(56) References Cited

U.S. PATENT DOCUMENTS

| | | | | |
|---|---|---|---|---|
| 5,574,547 | A * | 11/1996 | Denton | G03G 15/104 347/100 |
| 6,647,234 | B2 | 11/2003 | Herman et al. | |
| 6,719,406 | B1 | 4/2004 | Silverbrook et al. | |
| 7,292,810 | B2 | 11/2007 | Tanner et al. | |
| 8,968,974 | B2 | 3/2015 | Gila et al. | |
| 9,547,260 | B2 | 1/2017 | Lior et al. | |

(Continued)

FOREIGN PATENT DOCUMENTS

EP 0433012 A2 6/1991

OTHER PUBLICATIONS

Kahatabi, Rafael, et al. "Dielectric Properties Study of Thin Polymer Film Layers Used in LEP." NIP & Digital Fabrication Conference. vol. 2012. No. 2. Society for Imaging Science and Technology, 2012.

*Primary Examiner* — Walter L Lindsay, Jr.
*Assistant Examiner* — Jessica L Eley
(74) *Attorney, Agent, or Firm* — Fabian VanCott

(57) ABSTRACT

In one aspect an apparatus (200) for use in an electrographic printer (100) is described. The apparatus includes a housing (210) defining a cavity (220), a developer roller (250), a developer electrode (240) for developing printing substance onto the developer roller, the electrode being arranged within the cavity, and a heater (260) for heating printing substance to be developed onto the developer roller, the heater being arranged in the cavity.

12 Claims, 6 Drawing Sheets

(56) References Cited

U.S. PATENT DOCUMENTS

2006/0291908 A1* 12/2006 Watanabe ..... G03G 15/104
399/238
2008/0149189 A1* 6/2008 Jones ..... F16L 53/30
137/334

* cited by examiner

APPARATUS FOR USE IN AN ELECTROGRAPHIC PRINTER

BACKGROUND

An electrographic printing system may use digitally controlled lasers to create a latent image in the charged surface of a photo imaging plate (PIP). The lasers may be controlled according to digital instructions from a digital image file. Digital instructions may include one or more of the following parameters: image color, image spacing, image intensity, order of the color layers, etc. A printing substance may then be applied to the partially-charged surface of the PIP, recreating the desired image. The image may then be transferred from the PIP to a transfer blanket on a transfer cylinder and from the transfer blanket to the desired substrate, which may be placed into contact with the transfer blanket by an impression cylinder. The printing substance may be applied to the surface of the PIP from one or more printing substance application assemblies, such as developer units.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

DETAILED DESCRIPTION

Figure 1:
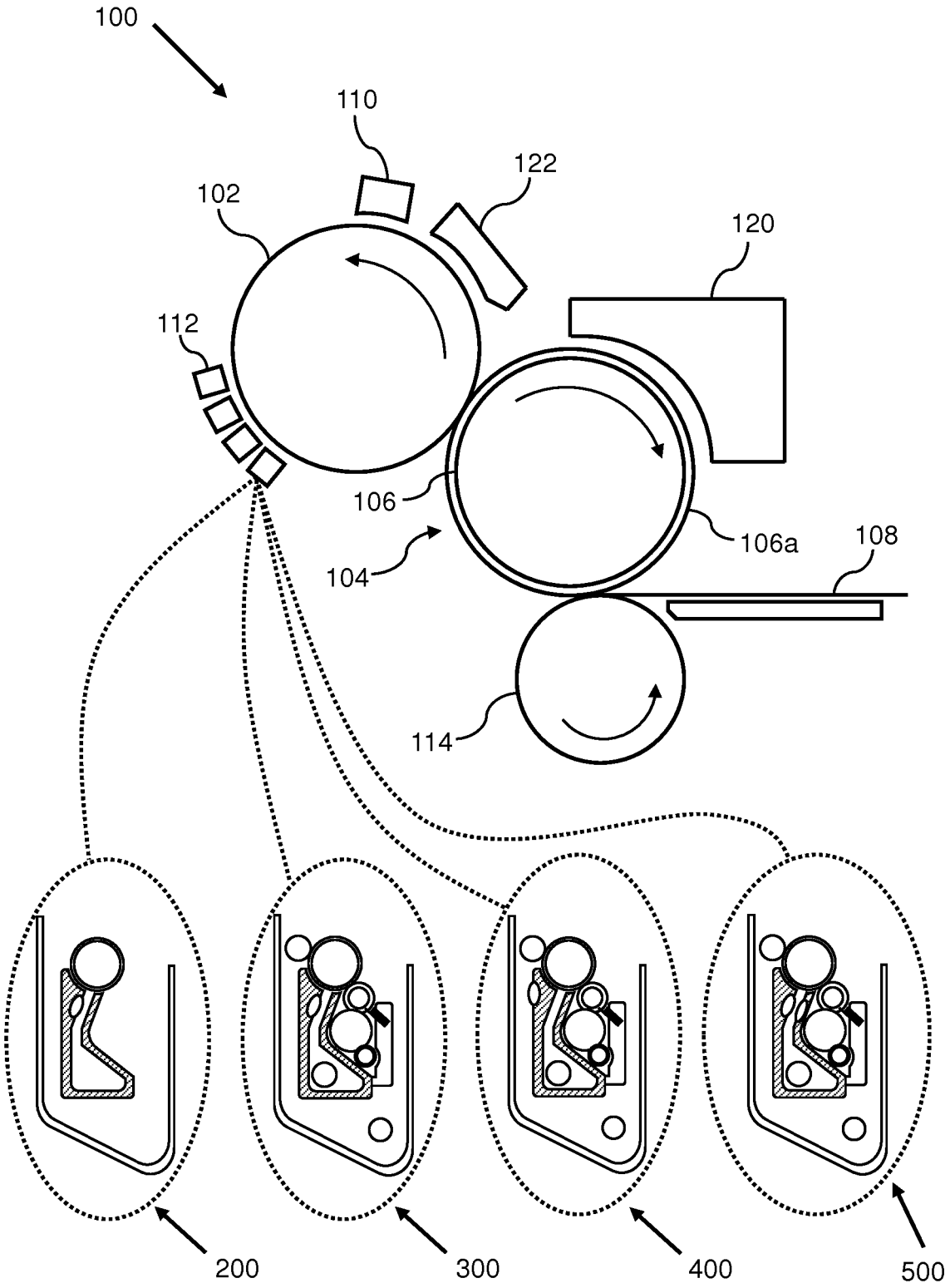
FIG. 1 is a schematic diagram showing an electrographic printer in accordance with an example of the present disclosure.

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Electrographic printing (also referred to as electrophotographic printing) refers to a process of printing in which a printing substance (e.g., a liquid or dry electrographic ink or toner) can be applied onto a surface having a pattern of electrostatic charge. The printing substance conforms to the electrostatic charge to form an image in the printing substance that corresponds to the electrostatic charge pattern.

In some electrographic printers, a printing substance may be transferred onto a photo-imaging cylinder by one or more developer units. In some examples, the printing substance may be liquid ink. In examples wherein the printing substance is a liquid ink, the developer unit may be referred to as an ink developer unit. In other examples the printing substance may be other than liquid ink, such as toner. In some examples, there may be one developer unit for each printing substance and/or printing substance color. During printing, the appropriate developer unit can be engaged with the photo-imaging cylinder. The engaged developer unit may present a uniform film of printing substance to the photo-imaging cylinder.

The printing substance may be liquid ink, such as electroink. In electroink, ink particles are suspended in a liquid carrier. In one example, ink particles can be incorporated into a resin that is suspended in a carrier liquid. Appropriate carrier liquids might include branched chain alkanes, such as isoparaffin. The ink particles may be electrically charged such that they can be controlled when subjected to an electric field. The printing substance may comprise electrically charged pigment particles that are attracted to oppositely charged electrical fields on the image areas of the photo-imaging cylinder. The printing substance may be repelled from the charged, non-image areas. The result may be that the photo-imaging cylinder is provided with the image, in the form of an appropriate pattern of the printing substance, on its surface. In other examples, such as those for black and white (monochromatic) printing, one or more developer units may alternatively be provided.

Particles of a printing substance may be referred to generally as ink particles (including particles in a liquid ink). Ink particles in the printer may be electrically charged such that they can be controlled when subjected to an electric field. The ink particles may be negatively charged and therefore repelled from the negatively charged portions of the photo imaging cylinder, and attracted to the discharged portions of the photo imaging cylinder.

Printing substances such as inks may have an optimal set point temperature. As used herein, 'optimal set point temperature' may refer to a temperature at which a printing substance exhibits desired characteristics, such as viscosity, charging, and fusing. Printing with a printing substance which is at its optimum set point temperature may provide high print quality, for example by providing good background and printing substance layer thickness (optical density) on a substrate. In some examples, the printing substance may have an optimal set point temperature of 30° C. However, in other examples, the ink may have an optimal set point temperature of greater than 30° C. It may be difficult to supply printing substance at this temperature.

There are therefore provided herein examples of apparatuses such as developer units which may develop printing substances in an electrographic printer at or near the optimal set point temperature of the printing substance. Certain examples will now be described in more detail with reference to the Figures.

FIG. 1 shows an electrographic printer 100, for use with developer units of the present disclosure, to print a desired image. A desired image may be initially formed on a photoconductor using a printing substance, such as liquid ink. In the example shown, the photoconductor is a photo-imaging cylinder 102, but in other examples the photoconductor may be a photoconductive plate, belt, or other conductive element. The printing substance, in the form of the image, may then be transferred from the photo-imaging cylinder 102 to an intermediate surface, such as the surface of a transfer element 104. The photo-imaging cylinder 102 may continue to rotate, passing through various stations to form the next image.

In the example depicted in FIG. 1, the transfer element 104 can comprise a transfer cylinder 106 and a transfer blanket **106*a* surrounding the transfer cylinder 106, and the surface of the transfer element 104 can be a surface of the transfer blanket 106*a*. The transfer element may otherwise be referred to as a transfer member 104. In other examples, transfer member 104** may comprise a continuous belt supporting a transfer blanket, or a continuous transfer blanket belt (wherein the transfer blanket is not disposed on a supporting member).

According to one example, an image may be formed on the photo-imaging cylinder 102 by rotating a clean, bare segment of the photo-imaging cylinder 102 under a photo charging unit 110. The photo charging unit 110 may include a charging device, such as corona wire, charge roller, or other charging device, and a laser imaging portion. A uniform static charge may be deposited on the photo-imaging cylinder 102 by the photo charging unit 110. As the photo-imaging cylinder 102 continues to rotate, the photo-imaging cylinder 102 can pass the laser imaging portion of the photo charging unit 110, which may dissipate localized charge in selected portions of the photo-imaging cylinder 102, to leave an invisible electrostatic charge pattern that corresponds to the image to be printed. In some examples, the photo charging unit 110 can apply a negative charge to the surface of the photo-imaging cylinder 102. In other examples, the charge may be a positive charge. The laser imaging portion of the photo charging unit 110 may then locally discharge portions of the photo imaging cylinder 102, resulting in local neutralized regions on the photo-imaging cylinder 102.

In this example, a printing substance may be transferred onto the photo-imaging cylinder 102 by one or more printing substance application assemblies, also referred to as developer units 112. In some examples, the printing substance may be liquid ink. In other examples the printing substance may be other than liquid ink, such as toner. In this example, there may be one developer unit 112 for each printing substance color. During printing, the appropriate developer unit 112 can be engaged with the photo-imaging cylinder 102. The engaged developer unit 112 may present a uniform film of printing substance to the photo-imaging cylinder 102. Developer unit 112 may include an apparatus 200, 300, 400, 500, as described in the following paragraphs.

In this example, following the provision of the printing substance on the photo-imaging cylinder 102, the photo-imaging cylinder 102 may continue to rotate and transfer the printing substance, in the form of the image, to the transfer member 104. In some examples, the transfer member 104 can be electrically charged to facilitate transfer of the image to the transfer member 104.

Once the photo-imaging cylinder 102 has transferred the printing substance to the transfer member 104, the photo-imaging cylinder 102 may rotate past a cleaning station 122 which can remove any residual printing substance and cool the photo-imaging cylinder 102 from heat transferred during contact with the hot blanket. At this point, in some examples, the photo-imaging cylinder 102 may have made a complete rotation and can be recharged ready for the next image.

In some examples, the transfer member 104 may be disposed to transfer the image directly from the transfer member 104 to the substrate 108. In some examples, where the electrographic printer is a liquid electrographic printer, the transfer member 104 may comprise a transfer blanket **106*a* to transfer the image directly from the transfer blanket to the substrate 108. In other examples, a transfer component may be provided between the transfer member 104 and the substrate 108, so that the transfer member 104 can transfer the image from the transfer member 104 towards the substrate 108**, via the transfer component.

In this example, the transfer member 104 may transfer the image from the transfer member 104 to a substrate 108 located between the transfer member 104 and an impression cylinder 114. This process may be repeated, if more than one colored printing substance layer is to be included in a final image to be provided on the substrate 108.

Figure 2:
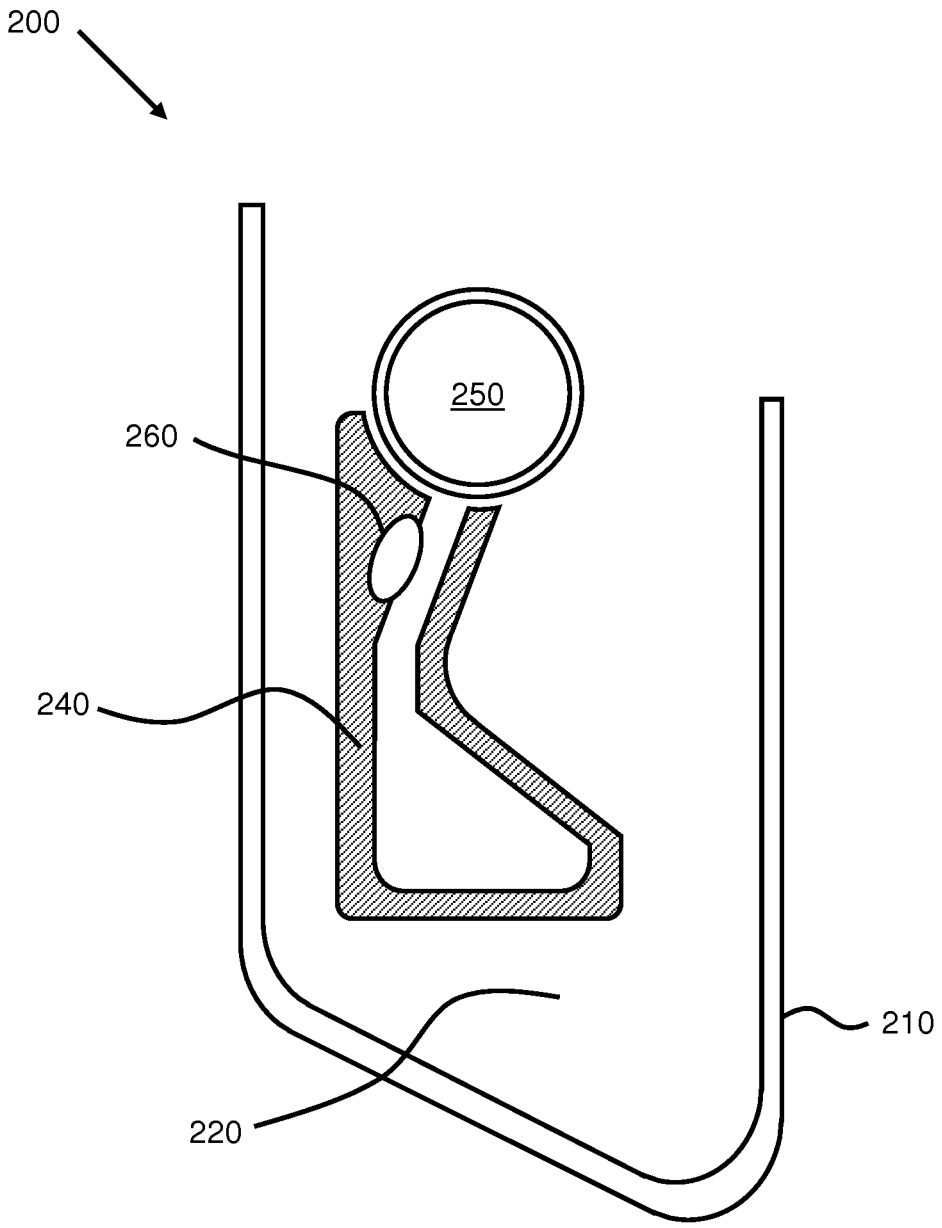
FIGS. 2, 3, 4 and 5 are schematic diagrams showing developer units according to examples of the present disclosure.

FIG. 2 shows an apparatus 200 according to an example of the present disclosure. The apparatus 200 is an apparatus for disposing printing substance onto a photoconductor. That is, apparatus 200 is a developer unit. The apparatus 200 may be an ink developer unit, for disposing ink onto a photoconductor. The apparatus comprises a housing 210 defining a cavity 220. The housing 210 may be provided to protect the components of the apparatus 200, and/or to prevent the release of printing substance into unwanted portions of the electrographic printer system in use. In some examples, the housing 210 may be formed of plastics. In other examples, the housing 210 may be formed of metal, such as aluminum.

The cavity 220 does not necessarily refer to an enclosed chamber. Rather, cavity 220 may be a volume within which components of the apparatus 200 may be arranged. It follows that housing 210 does not necessarily completely enclose a volume, and may comprise ports and openings to allow for material to enter or exit the cavity 220.

Arranged in the cavity is a developer electrode 240. The electrode 240 is arranged to develop printing substance such as ink onto developer roller 250. The electrode 240 and roller 250 may be arranged so that there is a gap between the electrode 250 and the roller 250. Developing printing substance to the developer roller may include generating an electrical potential between developer electrode 240 and developer roller 250, and thereby supplying at least some printing substance to the roller to provide a layer of printing substance. For example, supplying ink comprising charged pigment particles to the electrode 240 may impel said particles comprised in the ink to be deposited on the oppositely charged developer roller 250. The particles deposited on the developer roller 250 may form a film of ink particles to be transferred to a transfer element in the electrographic printer. Ink is not deposited on the developer roller 250 by contacting the roller 250 with a reservoir of ink.

In use, the electrode 240 may have may have an electric potential of from approximately 500V to 1500V, or from approximately 750 to 1250V, or of approximately 1000V.

The developer roller 250 may be provided as a cylinder rotatable around an axis arranged within the cavity 220. The developer roller 250 can be electrostatically charged to provide an electric potential between the electrode 240 and the developer roller 250. The developer roller may have a polyurethane coating, for example.

The apparatus 200 also comprises a heater 260. The heater 260 is arranged in the cavity, and is configured to heat printing substance to be developed onto the developer roller. As used herein, "to heat" means to supply thermal energy to a subject.

The heater 260 may be provided in any arrangement which may provide the printing substance with thermal energy. For example, the heater 260 may be arranged to directly heat the printing substance (that is, arranged such that printing substance passes over the heater 260 in use) as shown in FIG. 2. In other examples discussed hereinafter, the heater 260 may be arranged to indirectly heat the printing substance (that is, arranged to supply heat to an intermediate member, which in turn heats the printing substance).

The heater 260 may be formed of one or a plurality of heating elements. In some examples, the heater 260 may be formed of one or more resistive heating elements. That is, the heater 260 may provide thermal energy when supplied with an electrical current. Said resistive heating elements may be provided as resistive electrical wiring wound as a coil, or formed as a mesh, for example.

In some examples the heater 260 may be thermally insulated from the electrode 240. In other examples, the heater 260 may be in thermal communication with the electrode 240. In some examples, the heater 260 may be electrically insulated from the electrode 240. In other examples, the heater 250 may be in electrical communication with the electrode 260.

In some examples, the apparatus 200 may be configured for use with printing substance having an optimum set point temperature greater than 30° C. In some examples, the apparatus 200 may be configured for use with printing substances that are functional inks such as carbon nanotube-based inks (for example, inks comprising carbon nanotubes in an aqueous or oil suspension), or metallic inks (such as inks comprising copper, silver, silver particles coated with copper, barium titanate, zinc oxide, or combinations thereof). In some examples, the apparatus 200 may be configured for use with inks containing organic pigments, such as phthalocyanines.

In some examples, the heater 260 may be configured such that, in use, the heater 250 has a surface temperature of greater than or equal to 30° C., 40° C., 50° C., 60° C., 70° C., 80° C., 90° C., 100° C., 110° C., 120° C., 130° C., 140° C., or 150° C.

In some examples, the heater 260 may be configured such that, in use, the printing substance developed to developer roller 250 has a temperature of greater than or equal to 30° C., 40° C., 50° C., 60° C., 70° C., 80° C., 90° C., 100° C., 110° C., or 120° C. In some examples, heater 260 may be configured such that, in use, an ink developed to the developer roller 250 has a temperature less than the melting point of ink particles comprised in the ink.

In some examples, the heater 260 may be configured such that, in use, the heater 260 has a power output of equal to or greater than 200 W, 300 W, 400 W, or 500 W. The power output of the heater 260 may be controlled by controlling the power supplied to the heater 260.

In some examples, the apparatus may further comprise a temperature sensor (not pictured). In some examples the temperature sensor may be a thermistor, a resistive temperature detector, or a thermocouple. The temperature sensor may be arranged to determine a temperature at the heater 260, or at developer roller 250, or at the developer electrode 240, for example. In some examples, the temperature sensor may be arranged to determine a temperature of printing substance in the apparatus 200. The temperature sensor may determine a temperature and provide temperature data.

The temperature sensor and temperature data provided may be used to regulate the power supplied to the heater 260 so that the heater has a predetermined heat profile (for example, has a substantially constant power output). For example, the temperature sensor may provide temperature data to a controller in the electrographic printer, and the controller may control the power supplied to the heater 260 based on the temperature data.

In examples wherein the printing substance is an ink, heating the ink may mean that the ink has lower viscosity, thereby improving mobility of ink particles in the apparatus 200. Alternatively or additionally, heating the ink may increase the electronic conductivity of the ink. Alternatively or additionally, heating the ink to a temperature, for example to a temperature close to the melting point of a resin comprised in the ink, may provide good ink layer packing on the developer roller 250. Accordingly, the apparatuses of the present disclosure may provide images with high print quality.

Figure 3:
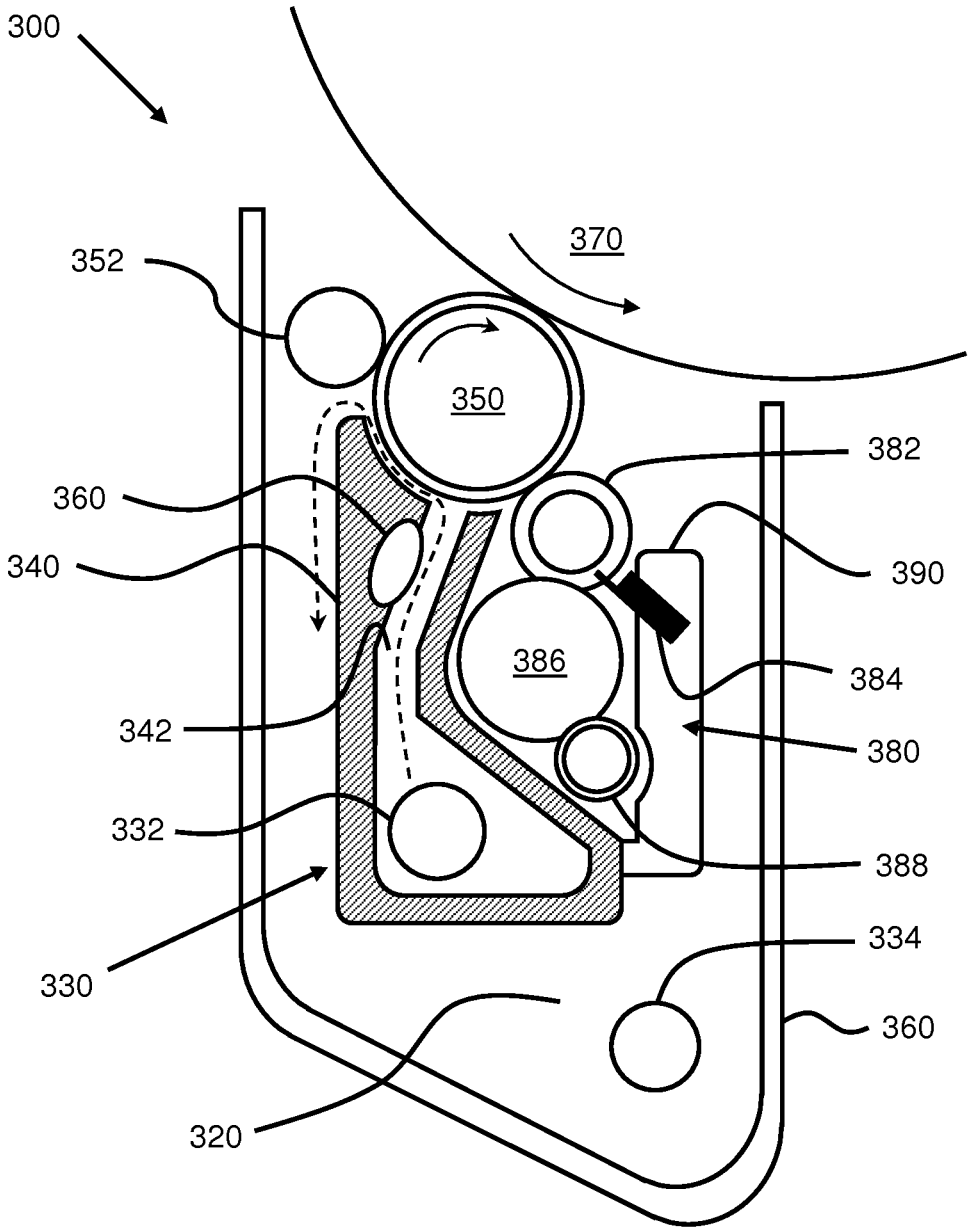

FIG. 3 shows an apparatus 300. For brevity, features in FIG. 3, the functions thereof that are the same as those features already described with reference to FIG. 2, are given similar reference numerals to those in FIG. 2 but increased by multiples of 100.

The apparatus 300 is an ink developer unit, and may comprise a developer assembly 330. The developer assembly 330 may comprise, for example, an ink inlet 332, an ink outlet 334, a developer electrode 340, a developer roller 350, a squeegee roller 352, and a heater 360.

In use, the apparatus 300 may receive ink from an ink tank (not pictured) through inlet 332. The ink supplied to the apparatus 300 (also referred to as undeveloped ink) may comprise about 3% non-volatile solids by volume, such as about 3% ink particles by volume. The ink tank may be arranged separately from the apparatus 300 in an electrographic printer, and may be connected to inlet 332 by a conduit (not pictured). The ink tank may or may not supply thermal energy to the ink. However, the ink may lose thermal energy as it travels through the conduit to the apparatus 300. The ink supplied to the apparatus may travel through the apparatus 300 as shown by the dashed arrow. Firstly, the ink may pass through channel 342 in the electrode 340, which may cause some of the ink particles to become charged.

The ink may then pass between the electrode 340 and the developer roller 350, wherein some of the charged particles may be developed onto the surface of the developer roller 350. The ink disposed on the surface of the developer roller 350 may then be dispersed into a layer of more uniform thickness by the squeegee roller 352, and then transferred to the photo-imaging cylinder 370. The ink disposed on the surface of the developer roller 350 (also referred to as developed ink) may comprise about 20% non-volatile solids by volume, such as about 20% ink particles by volume.

The apparatus 300 may also comprise a cleaning unit 380, which may include a cleaning roller 382, wiper 384, a sponge roller 386, and a squeezer roller 388. The wiper may be supported by a wiper wall 390 in the cleaning unit 380. The cleaning unit 380 may be arranged such that, in use, residual ink left on the developer roller 350 after ink has been transferred to the photo-imaging cylinder 370 may be transferred to the cleaning roller 382. In turn, the sponge roller 386 may remove ink from the surface of the cleaning roller 382, and then the squeezer roller 388 may remove ink from the sponge roller 386. Wiper 384 may also be used to ensure that portions of the surface of the cleaning roller 382 are substantially free of ink before contacting the developer roller 350 again.

Ink which is not transferred to the developer roller 350 may accumulate in the cavity 320, and may flow from the apparatus 300 through ink outlet 334. Ink may exit the apparatus 300 through ink outlet 334 and return to the ink tank (not pictured).

Figure 4:
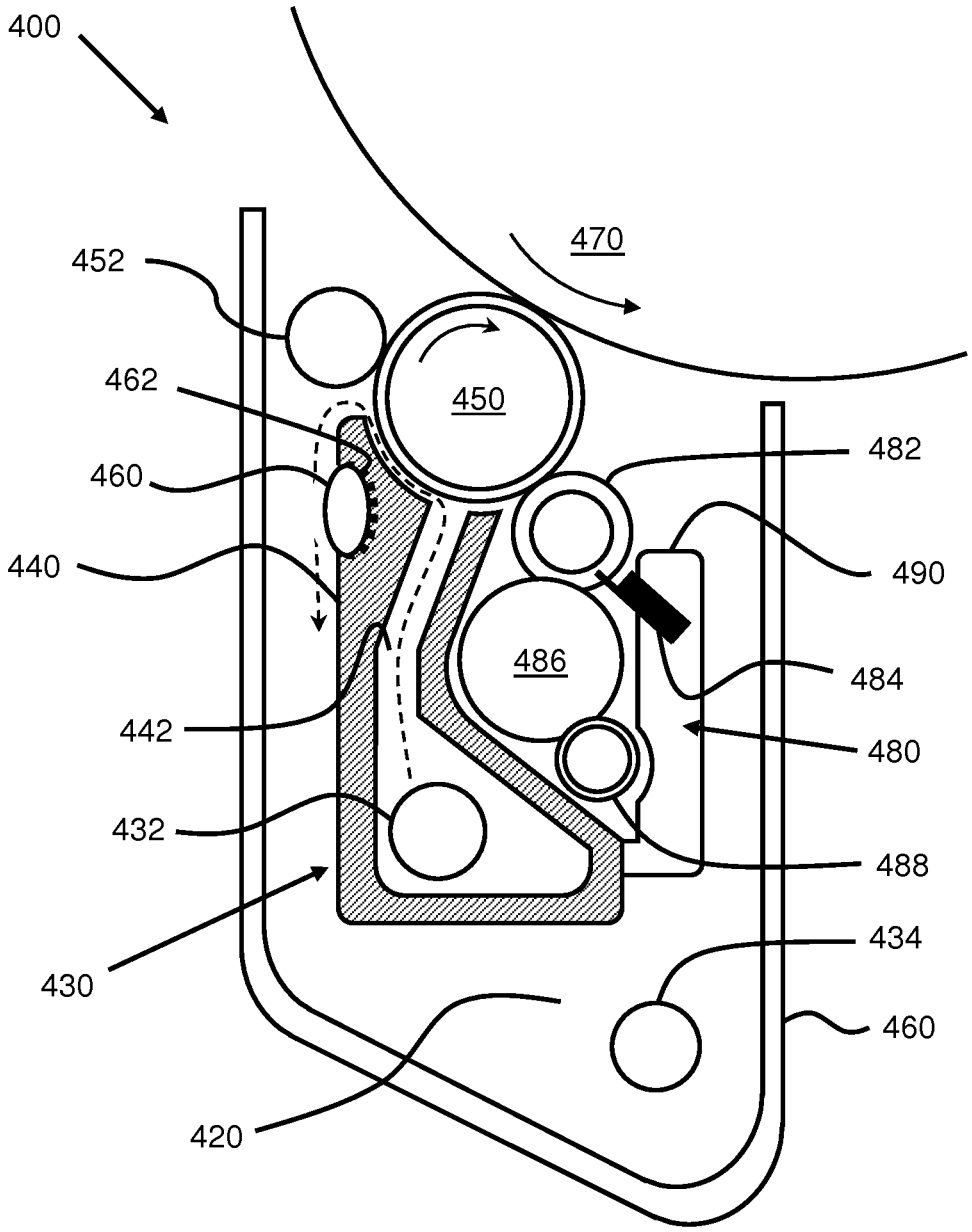

FIG. 4 shows an apparatus 400 according to another example of the present disclosure. The apparatus 400 is a developer unit. For brevity, features in FIGS. 4 and 5, the functions thereof that are the same as those features already described with reference to FIG. 3, are given similar reference numerals to those in FIG. 3 but increased by multiples of 100.

Heater 460 is arranged in apparatus 400 such that, in use, thermal energy is not directly supplied from heater 460 to printing substance which is supplied to the apparatus 400. That is, printing substance does not directly pass over heater 460 in use. In this example, heater 460 supplies thermal energy to electrode 430 in use. Electrode 430 thus supplies thermal energy to the printing substance supplied to the electrode in use. Thus, heater 460 indirectly heats the printing substance by supplying thermal energy directly to the electrode 430. In this example, electrode 430 may be referred to as an intermediate member for supplying heat to the printing substance. Heating a printing substance such as ink indirectly may result in less ink fouling of the heater in use.

In this example, the apparatus may comprise a thermal bridge 462. The thermal bridge 462 may be arranged between the heater 460 and the electrode 430. A thermal bridge refers to any member which conducts thermal energy from heater 460 to electrode 430. A thermal bridge may include a thermal conduit (such as a metallic wire). A thermal bridge may also be provided by heater 460 abutting or being in close proximity to electrode 430.

Figure 5:
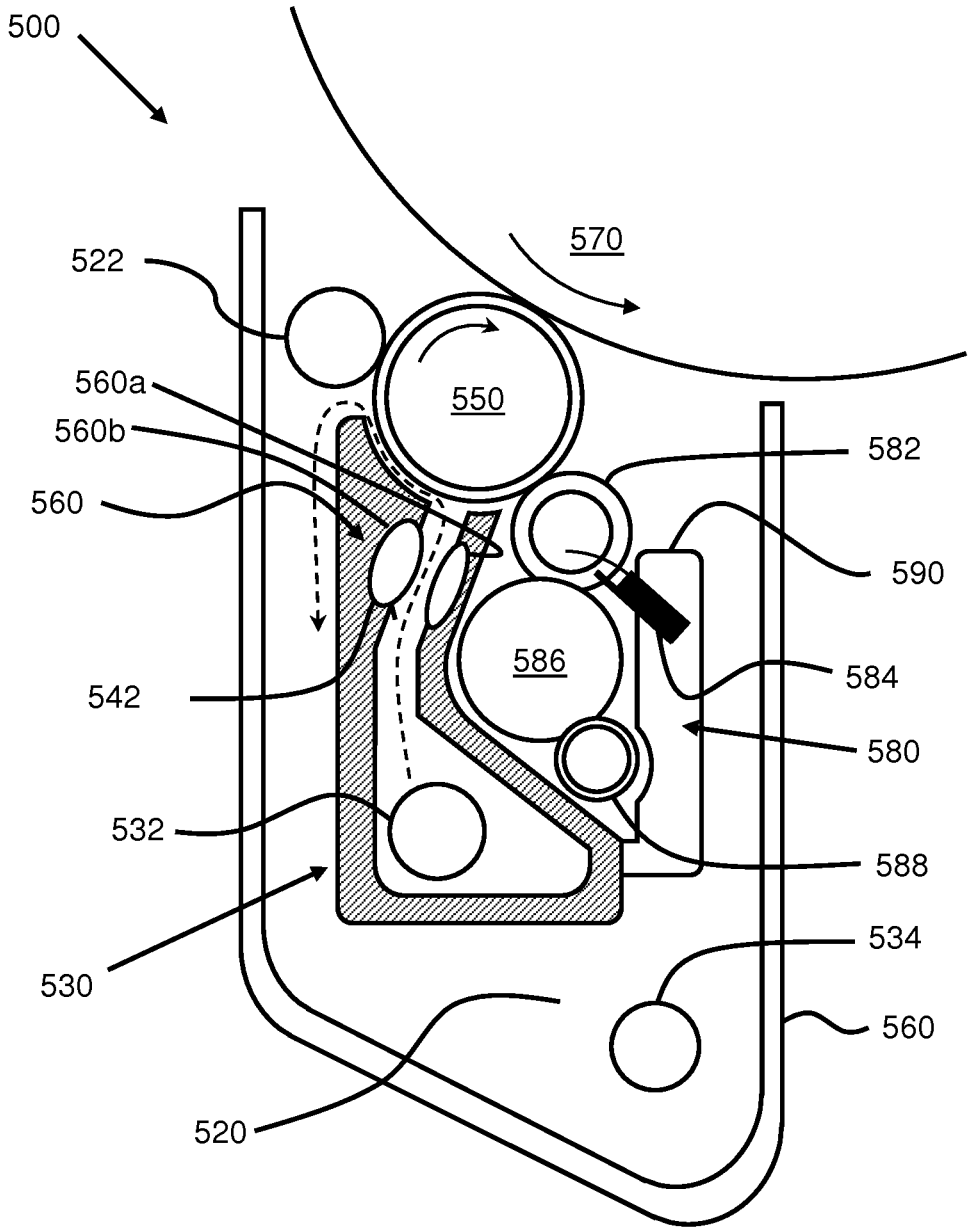

FIG. 5 shows an apparatus 500 according to another example of the present disclosure. As discussed hereinabove, heater 560 may comprise a plurality of heating elements. In this example, heater 560 is formed of heating elements 560*a* and 560*b*. Heating elements 560*a* and 560*b* may be arranged on opposite sides of channel 552. Said arrangement may provide efficient heating of the printing substance passing through channel 552.

Figure 6:
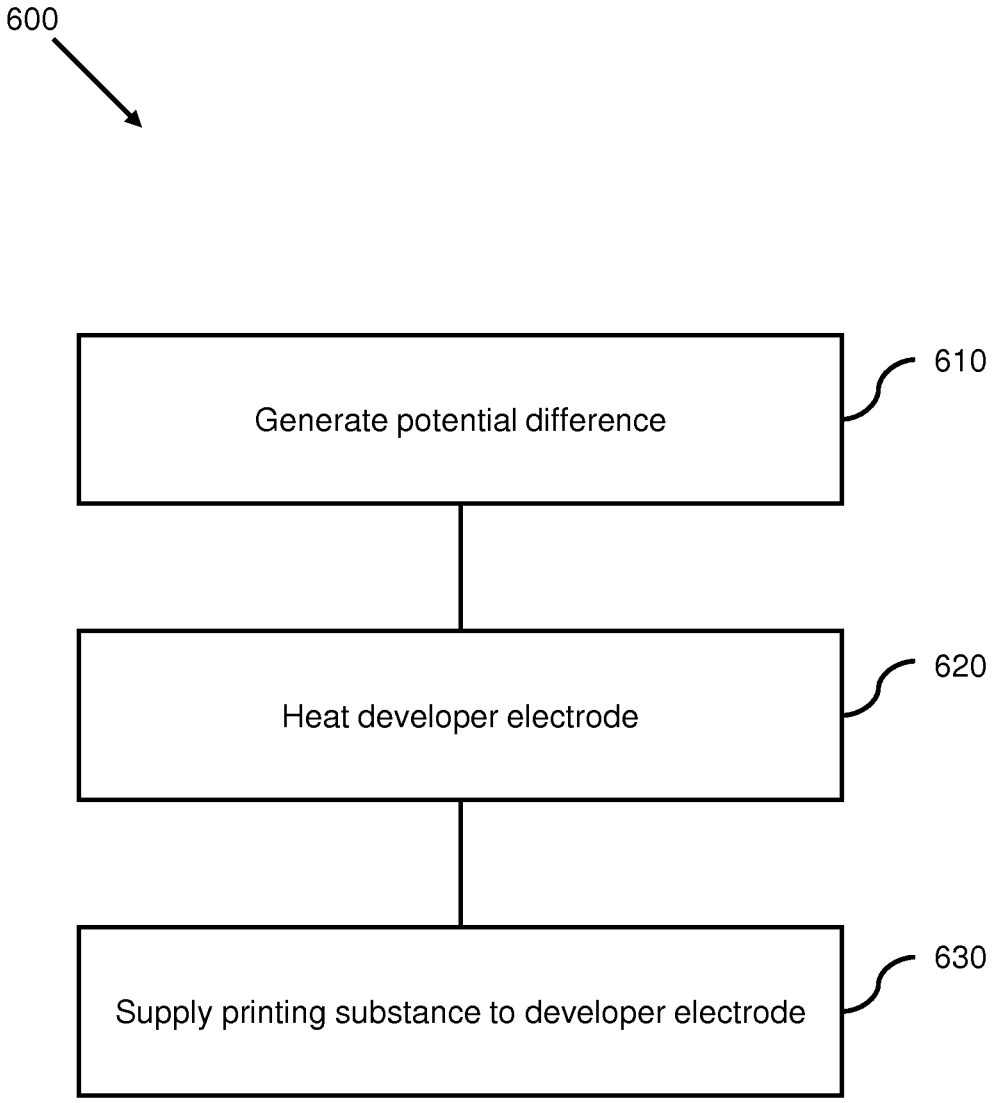
FIG. 6 is a flowchart showing a method of developing printing substance to a developer roller in accordance with an example of the present disclosure.

FIG. 6 shows a method 600 of providing printing substance to a developer roll in an electrographic printer. Method 600 include block 610, comprising generating a potential difference between a developer electrode and a developer roller. Generating said potential difference compels charged particles to develop on the developer roller.

Method 600 further includes block 620, comprising heating the developer electrode. Heat is supplied to the developer electrode so that printing substance supplied to the electrode receives heat from the electrode.

In some examples, block 620 may comprise heating the developer electrode such that the electrode has a surface temperature of greater than or equal to 30° C., 40° C., 50° C., 60° C., 70° C., 80° C., 90° C., 100° C., 110° C., 120° C., 130° C., 140° C., or 150° C.

In some examples, block 620 may comprise heating printing substance such as ink to 30° C., 40° C., 50° C., 60° C., 70° C., 80° C., 90° C., 100° C., 110° C., or 120° C. In some examples, block 620 may comprise heating an ink to a temperature less than the melting point of ink particles comprised in the ink.

In some examples, heating the electrode may comprise supplying a current to a resistive heater, and transferring a portion of the heat generated to the electrode. Block 620 may comprise supplying power to a resistive heater. Block 620 may further comprise controlling the power supplied to the heater.

Method 600 further include block 630, comprising supplying printing substance to the developer electrode. Supplying printing substance to the developer electrode heats the printing substance. In examples wherein the printing substance is an ink, this may mean that the ink has lower viscosity, thereby improving mobility of ink particles. Alternatively or additionally, heating the ink may increase the electronic conductivity of the ink. Alternatively or additionally, heating the ink to a temperature, for example to a temperature close to the melting point of a resin comprised in the ink, may good ink layer packing on the developer roller. Accordingly, the apparatuses of the present disclosure may provide images with high print quality.

Supplying ink to the developer electrode also introduces charged particles in the ink to the potential difference between the electrode and the developer roller. Accordingly a portion of the ink is developed to the developer roller. The ink supplied to the electrode may be any of those described hereinabove. Supplying ink to the developer roller electrostatically may provide an efficient means of conveying ink without fouling components in the apparatus.

In some examples, blocks 610, 620 and 630 may be carried out at the same time. In further examples, blocks 610 and 620 may be carried out as part of continuous process. That is, blocks 610 and 620 may be carried out substantially continuously in a printing process.

A further example of the present disclosure is an electrographic printer comprising an ink developer unit and an ink tank. The ink developer unit may correspond to any of those described herein. The ink tank comprises a container for retaining ink, arranged to supply ink to the ink developer unit.

In an example, the ink tank is arranged in the electrographic printer to be accessible by a user. Arranging the ink tank thus may allow a user to refill the ink tank with ink without interfering with the ink developer unit.

In some examples, the electrographic printer comprises a controller for controlling the power supplied to the heater in the ink developer unit. In some examples, the ink developer unit comprises a temperature sensor as discussed hereinabove (for example, the temperature sensor may be arranged to determine a temperature at the heater and provide temperature data). Data from the temperature sensor may be used to regulate the power supplied to the heater 250 so that the heater has a predetermined heat profile (for example, has a substantially constant power output). For example, the temperature sensor may provide temperature data to a controller in the electrographic printer, and the controller may control the power supplied to the heater 250 based on the temperature data.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A method of providing printing substance to a developer roll in an electrographic printer, the method comprising:

generating a potential difference between a developer electrode and a developer roller, heating the developer electrode, and supplying printing substance to a channel through the developer electrode to the developer roller, thereby heating the printing substance and developing a portion of the printing substance to the developer roller.

2. The method of claim 1, wherein the printing substance is a metallic ink.

3. The method of claim 1, wherein the printing substance is heated to a temperature of greater than or equal to 30° C.

4. The method of claim 1, wherein heating the developer electrode comprises supplying power to a heater which is in thermal communication with the developer electrode.

5. An electrographic printer comprising:

an ink developer unit, comprising:

a housing defining a cavity;

a developer roller;

a developer electrode for developing ink onto the developer roller, the electrode being arranged within the cavity, the developer electrode comprising a channel within the electrode for directing ink from an ink inlet to the developer electrode; and a heater for heating ink in the channel to be developed onto the developer roller, the heater being arranged in the cavity.

6. The electrographic printer of claim 5, further comprising an ink tank in communication with the ink inlet; wherein the ink tank is arranged to supply ink to the ink developer unit.

7. The electrographic printer of claim 5, wherein:

the apparatus further comprises a temperature sensor for determining a temperature at the heater and providing temperature data; and the electrographic printer further comprises a controller for controlling supply of power to the heater;

wherein the controller controls supply of power to the heater based on the temperature data provided by the temperature sensor.

8. The electrophotographic printer of claim 5, wherein the heater is disposed in the channel.

9. The electrophotographic printer of claim 5, wherein the heater is disposed outside the channel to heat the electrode in order to heat the ink in the channel.

10. The electrophotographic printer of claim 5, wherein the heater comprises two heating units disposed on opposite sides of the channel.

11. The electrophotographic printer of claim 5, wherein the developer electrode surrounds the ink inlet where ink enters the cavity to direct ink into the channel.

12. An apparatus for use in an electrographic printer, the apparatus comprising:

a housing defining a cavity;

a developer roller;

a developer electrode for developing printing substance onto the developer roller, the electrode being arranged within the cavity; and a heater for heating printing substance to be developed onto the developer roller, the heater being disposed on the developer electrode in the cavity;

wherein the developer electrode comprises a channel within the developer electrode to direct ink to the developer roller.

* * * * *